United States Patent [19]

Ryan

[11] Patent Number: 4,911,565

[45] Date of Patent: Mar. 27, 1990

[54] DEVICE FOR ONE-HANDED GENERATION OF ALPHA-NUMBERIC CHARACTERS

[76] Inventor: Terry Ryan, 2097 Maynard Street, Halifax, Nova Scotia, Canada, B3K 3T3

[21] Appl. No.: 296,351

[22] Filed: Jan. 11, 1989

Related U.S. Application Data

[63] Continuation of Ser. No. 105,727, Oct. 7, 1987, abandoned, which is a continuation-in-part of Ser. No. 809,259, Dec. 16, 1985, abandoned.

[30] Foreign Application Priority Data

Dec. 21, 1984 [CA] Canada ..... 470869

[51] Int. Cl.[4] ..... B41J 5/06

[52] U.S. Cl. ..... 400/100; 400/485

[58] Field of Search ..... 400/87, 89, 91, 100, 400/101, 102, 485, 486, 489; 178/17 A, 17 C, 118; 340/365 R, 365 VL; 434/112, 113, 114

[56] References Cited

U.S. PATENT DOCUMENTS

| | | | |
|---|---|---|---|
| 600,119 | 3/1898 | Cahill | 400/101 |
| 720,068 | 2/1903 | Reese | 434/112 |
| 2,972,140 | 2/1961 | Hirsch | 434/113 |
| 3,790,708 | 2/1974 | Bugg, Sr. et al. | 178/17 C |
| 3,831,730 | 8/1974 | Koeppe | 178/17 C |
| 3,937,939 | 2/1976 | Frenkel | 235/145 R X |
| 4,042,777 | 8/1977 | Bequaert et al. | 400/100 X |
| 4,307,970 | 12/1981 | McGaughey, Jr. et al. | 400/482 |
| 4,655,621 | 4/1987 | Holden | 400/100 |

FOREIGN PATENT DOCUMENTS

| | | | |
|---|---|---|---|
| 213022 | 3/1987 | European Pat. Off. | 400/489 |
| 308048 | 9/1918 | Fed. Rep. of Germany | 400/489 |
| 99536 | 6/1984 | Japan | 340/365 VL |
| 738914 | 6/1980 | U.S.S.R. | 400/100 |

*Primary Examiner*—David A. Wiecking
*Attorney, Agent, or Firm*—James W. Hellwege

[57] ABSTRACT

A device for one-handed generation of alpha-numeric characters in an alpha or numeric mode including letters, numerals, punctuation marks and mathematical function symbols is provided, comprising a finger key section comprising a first array of four finger keys and a second array of four finger keys, respective keys of said first and second arrays arranged in adjacent pairs, said finger keys each operable individually to generate a single character at a time, said first array of finger keys in an alpha mode assigned to the generation of all of the consonants and said second array of finger keys in an alpha mode being assigned to the generation of all of the vowels, one of said arrays in a numeric mode being assigned to the generation of numerals and mathematical symbols, a thumb key section comprising at least one array of four thumb keys, said thumb keys of said array in an alpha mode assigning said first array of finger keys to the generation of consonants and in a numeric mode assigning to one of said arrays the generation of numerals 0–9 and mathematical symbols, with each of the thumb keys of said at least one array operable to assign a preselected group of characters to said finger keys with the groups of characters to which the respective finger keys are assigned being arranged sequentially in alphabetical or numerical order and thumb-operated control key means comprising a plurality of said thumb keys initiating either said alpha or numeric mode, and means responsive to the operation of said keys for generating signals representing a particular alpha-numeric character.

7 Claims, 4 Drawing Sheets

| Th. | I.F | M.F. | R.F | L.F |
|---|---|---|---|---|
| | A/B | →/C | E/D | ←/F |
| G | ↑/G | I/H | ↓/J | TAB/K |
| L | (/)/L | ;/:/M | O/N | %/P |
| Q | ?/\|/Q | %/R | -/_/S | U/T |
| V | //\/V | ^/{}/W | Y/X | '/Z |

FIG. 3a

| Th | I.F. | M.F. | R.F. | L.F. |
|---|---|---|---|---|
| | 1 | 2 | 3 | 4 |
| 5 | 5 | 6 | 7 | 8 |
| 9 | 9 | 0 | . | = |
| + | + | − | X | ÷ |
| √ | √ | % | MEM | CI |

FIG. 3b

DEVICE FOR ONE-HANDED GENERATION OF ALPHA-NUMBERIC CHARACTERS

This application is a continuation of application Ser. No. 105,727, filed 10/07/87, which is a continuation-in-part of Ser. No. 809,259 filed Dec. 15, 1985, now abandoned.

This invention relates to a method and device for one-handed generation and reception of alpha-numeric characters like letters, numerals, punctuation marks and mathematical function symbols. The device is intended for word-processing using a video terminal, computers and for other applications.

The device is also intended to be used for the sending and receiving of messages by touch sensitive transmission without the use of a terminal or printer. It also has application as a communication and reading device for the blind.

The conventional two-handed typewriter keyboard has been in us for decades. It is desirable to replace such voluminous keyboards with smaller and simpler devices which can be operated with one hand only. It is, of course, desirable that the one-handed keyboard have as few keys as possible in order to minimize the size of the keyboard without affecting its operation.

When a keyboard is uses having relatively few keys it is difficult to generate a large number of varying characters. Two basic solutions to this problem are known in the prior art. First, it is known, e.g. from U.S. Pat. No. 4,042,777 issued Aug. 16, 1977 to Bequaert et al to depress one or more keys simultaneously in order to generate a character or a group of characters. This method is usually referred to as chord forming. Secondly, it is possible to depress two or more keys in a sequence in order to generate a character or a group of characters. U.S. Pat. Nos. 4,344,069 and 4,381,502 are examples of the second method.

A considerable amount of effort has been made to simplify the operation of a one-handed keyboard. Instead of usual typist training, however, the prior art solutions of one-handed keyboards give the option of leaning chords, as for instance in the U.S. Pat. No. 4,042,777, where ten finger-controlled keys and a number of thumb-controlled keys are provided. The thumb positions on the thumb keys select the alphabet/case, output order of character in the chord, space and capitalizing. When the alphabet mode (register) is selected, the user faces all the letter positions on the finger keys and has two options: either to generate chords or to type one character at a time. Since the arrangement of the characters on the reduced-size keyboard is different than on a standard typewriter keyboard, another learning effort is required on the part of the typist in both cases.

The present invention is aimed at simplifying the operation of a one-handed alpha-numeric keyboard through dividing the total number of characters to be generated into groups sequentially where applicable, and assigning the groups to finger-operated keys by the operation of thumb-operated keys. The invention is intended as a method of generating and receiving alpha-numeric characters which can be learned quickly and a device implementing such method.

The device of this invention comprises, in general, a finger key section structured to form one array of four finger keys and a second array of four finger keys. One finger key of the first array and one finger key of the second array are arranged in pairs. The finger keys are adapted to be operated individually to generate a single character at a time. It further comprises a thumb key section having a plurality of thumb-operated keys, cue keys, each of the cue keys operable to assign a preselected group of characters to said finger keys. Where such a group of characters is part of letter alphabet or numeric alphabet, the characters in the group are arrange sequentially.

The device also comprises means responsive to the operation of said finger keys and thumb keys for generating signals representing a particular alpha-numeric character.

In some applications of the device this generating of signals will be interactive, that is the keys can both send or receive an alpha-numeric character.

The finger key section comprises four finger keys in one array and four finger keys in a second array. The thumb-operated cue keys are adapted each to assign a group of up to and including eight different characters to said finger keys, one character to one finger key.

A method of generating alpha-numeric characters by means of a one-handed keyboard having finger-operated entry keys and thumb-operated cue keys is provided comprising the following steps:

selecting a group of characters including the character to be generated, the group controlled by one of the cue keys;

engaging said cue key to assign said group of characters to the finger-operated entry keys, one character being assigned to one entry key at a time; and engaging the entry key corresponding to said character to be generated;

wherein each such group being part of letter alphabet or numeric alphabet is arranged and assigned to said entry keys in a sequential manner. This means that letters are arranged in alpabetical order.

In the receiving mode the fingers are placed on the finger keys and the thumb is placed across the cue keys. The incoming alpha-numeric character raises a finger and thumb key which the receiver can recognize.

The method provides for letters to be assignable to finger keys in a manner distinguishing the positions of consonants from the positions of vowels. The consonants are assigned to one of such arrays, and vowels to the other array.

Referring back to the device of this invention, the finger key section can be structured analogically to a piano keyboard. Thus, one of the arrays of keys corresponds to white keys of a piano keyboard while the other array forms a row corresponding to black keys of the keyboard. Understandably, the keys in both arrays form pairs falling under fingers of the typist's hand.

Another version of the device can be designed as keys on a cylinder whereby a control stick is obtained.

In the disclosure and claims, the terms "engage" and "depress" are used. It is appreciated that touch-sensitive means are commonly known in the prior art and therefore, these terms comprise both the meanings, i.e. mechanical and touch-sensitive operation of the keys. Since the means responsive to the operation of keys to generate alpha-numeric signals are also known in the art and their use would be obvious to one skilled in the art, such means are not explained in detail in the description to follow.

In drawings which illustrate exemplary embodiments of the invention

FIGS. 3*a* and 3*b* are schematic views illustrating the distribution of alpha-numeric characters into groups assignable to the finger keys, FIG. 3*a* showing the alphabet mode and FIG. 3*b*, the numeric mode.

Figure 4:
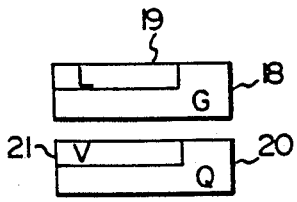

FIG. 4 shows a CRT display used for operator training purposes, with the finger key section and part of the thumb key section displayed.

Figure 5:
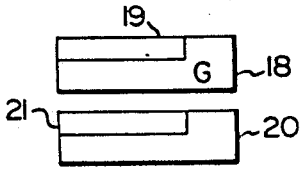
Figure 6:
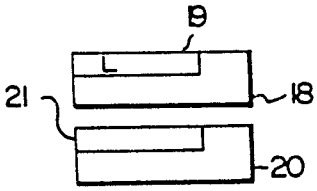
Figure 7:
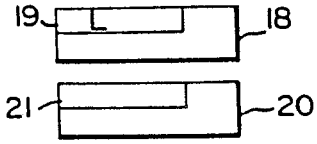
Figure 7:
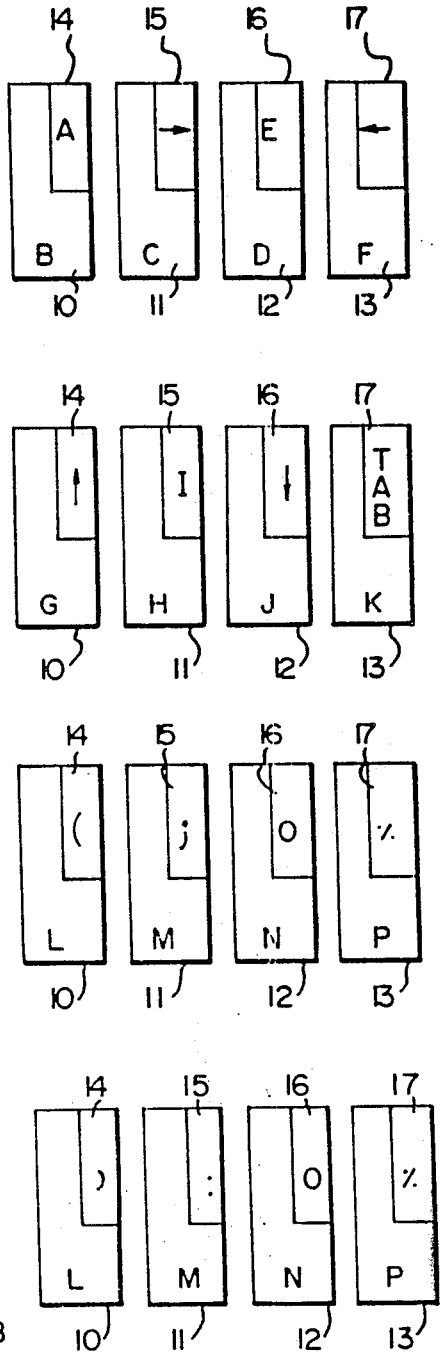

FIGS. 5, 6 and 7 show the CRT display in selected stages.

Figure 8:
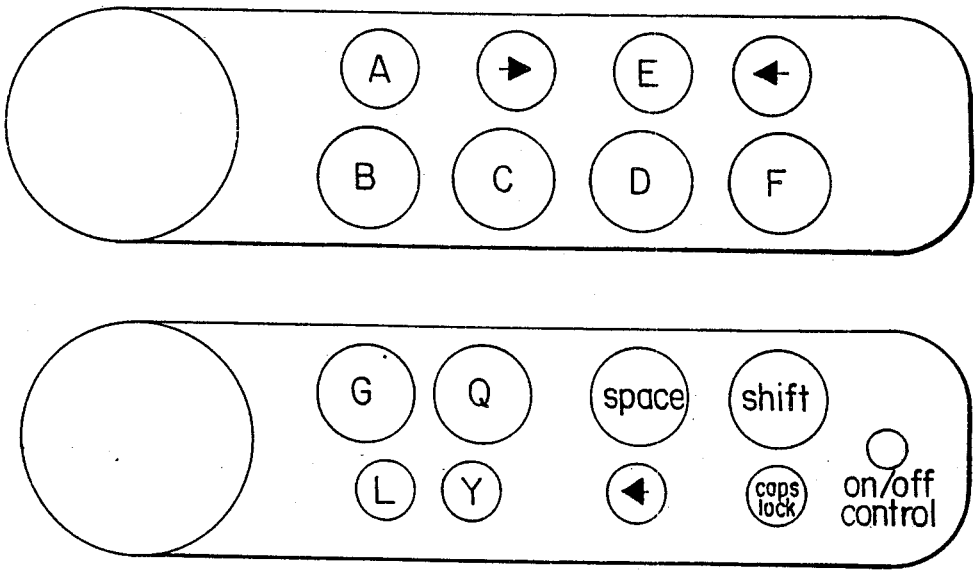

FIG. 8 shows a cylinder having a finger key section and a thumb key section.

Figure 1:
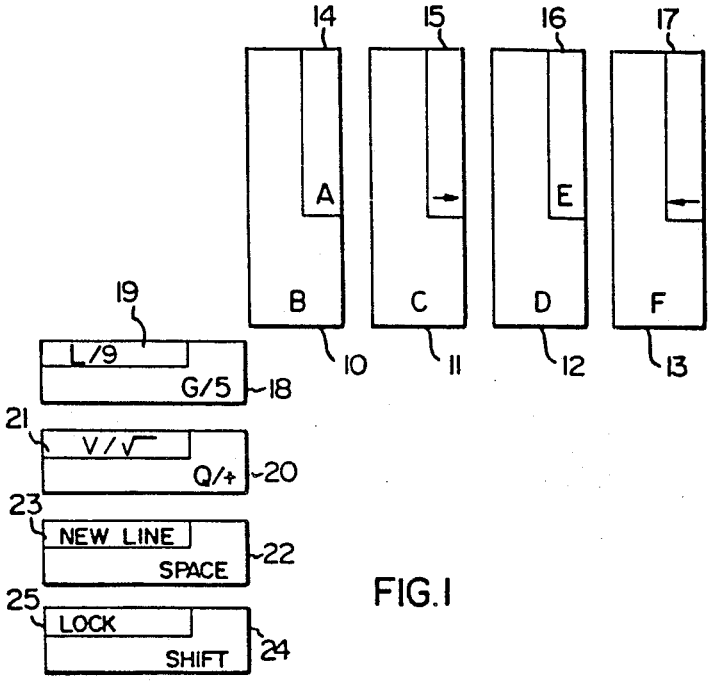
FIG. 1 is a top view of one embodiment showing the keyboard in alphabet mode.

Referring to FIG. 1, an exemplary device is shown having a keyboard similar to a piano keyboard. Four "tone" keys 10, 11, 12, 13 and four "semitone" keys 14, 15, 16, 17 constitute the finger key section of the device.

A thumb key section is shown as comprising four cue keys 18, 19, 20 and 21 and four function (switch) keys 22, 23, 24, and 25. A single key 26 is provided to be operated either as a power on/off key or a control key. The purpose of the thumb-operated keys is explained below in more detail.

It is to note that the terms "finger operated" or "finger keys" suggest the most functional, natural way of operating these keys and the user, of course, is not precluded from operating thumb keys with his/her fingers and vice versa.

The key 26 serves as a power on/off key if pressed and held for about three seconds, or as a control key if touched shortly. This sets the finger key section in a numeric mode, including mathematical function symbols or back onto alphabet mode.

It is also conceivable to substitute two separate keys for the single key 26.

When the keyboard is in the alphabet mode and no thumb cue key is engaged, the tone key 10 is assigned consonant B, tone key 11, consonant C, tone key 12, D and key 13 is assigned consonant F. The symbols assigned to the semitone keys are shown in FIG. 1. Thus, vowels are arranged separately and yet in their alphabetical sequence to make the arrangement easily memorizable.

Figure 2:
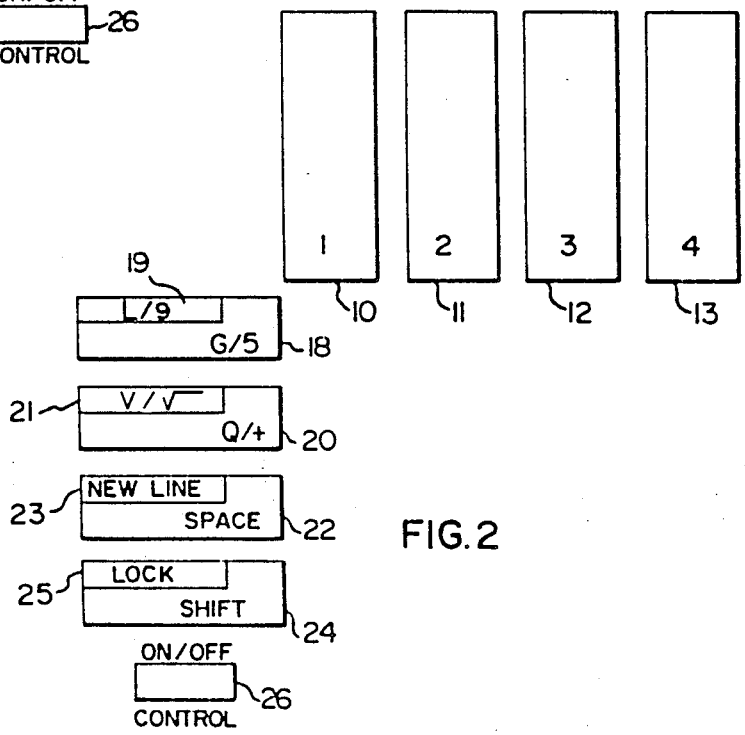
FIG. 2 is a top view of the embodiment with the keyboard in numeric mode.

FIG. 2 shows the arrangement of characters as assigned to the finger keys when the device is in the numeric mode and no thumb cue key is engaged.

Starting from the position shown in FIG. 1, depressing cue key 18 assigns another group of characters to the finger keys 10 thru 17. The consecutive arrangements obtained by pressing cue keys 19, 20, 21 are illustrated in FIG. 3*a*. Starting from the position shown in FIG. 2, consecutive arrangements will be obtained in numeric mode as illustrated in FIG. 3*b*. The abbreviations at the top of FIGS. 3*a* and 3*b* stand for thumb, index finger, middle finger, ring finger and little finger.

As explained above, the thumb-operated keys 18, 19, 20, 21 are cue keys operable to assign preselected groups of characters to be generated by the finger keys according to FIGS. 3*a* and 3*b*. There are also provided in the thumb key section so-called function or switch keys whose purpose is as follows:

key 22 is space key
key 23 is "new line" (carriage return) key
key 24 is shift key for upper case (hitting the shift key once shifts the new letter to be upper case)
key 25 locks and unlocks upper case
key 26 is a dual purpose key as explained above.

FIGS. 4–7 illustrate a possibility of user training using a CRT display. With the power switch on, the display for the top half of the screen will be as shown in FIG. 4. At the bottom of the display, not shown herein, an introductory tape can be provided to print out and scroll up special instructions such as the sequence for changing from alphabet mode to numeric mode and vice versa.

By way of example, when the cue key 18 (G) is depressed starting from the position of FIG. 4, the "G" panel at the left of the display lights up; display a the right of the panel changes to that shown in FIG. 5.

The use of the "shift" key is illustrated in FIGS. 6 and 7. This key is used for changing from lower to upper case and also for selecting those characters that are indicated in "pairs" on one finger key. As shown in FIG. 6, when the cue key "L" is depressed (in alphabet mode), the "L" panel at the left of the display lights up and the display at the right changes to that shown in FIG. 6, with "open bracket" assigned to the index finger, semicolon to the middle finger, and the vowel o and period (full stop) assigned to the ring finger and the little finger accordingly. However, when the shift key 24 is hit once and then the cue key "L" is depressed, the display will show as in FIG. 7.

Following is a description of the characters assigned to the finger keys for the one-handed alpha-numeric keyboard.

For the sake of clarity and convenience, the consonant key will be called the tone key; the vowel key will be called the semi-tone key. For the alpha mode the values are as follows:

FIRST SERIES

The thumb is not used.
The index finger tone key is B
The index finger semi-tone key is A
The middle finger tone key is C
The middle finger semi-tone key moves cursor to the right (or forward in a document)
The third finger tone key is D
The third finger semi-tone key is E
The little finger tone key is F
The little finger semi-tone key moves cursor to the left (or backward in a document)

SECOND SERIES

The thumb depresses the first cue key 18. This cues the finger keys to bring up the second series values. With the first cue key engaged the finger key values become:

The index finger tone key is G
The index finger semi-tone key moves the cursor up (or backwards line by line in a document)
The middle finger tone key is H
The middle finger semi-tone key is I (i)
These are all upper and lower case keys except where noted.
The third finger tone key is J
The third finger semi-tone key moves the cursor down (or forwards line by line in a document)
The little finger tone key is K
The little finger semi-tone key is Tab to preset margin

THIRD SERIES

The thumb depresses the second cue key 19. This cues the finger keys to bring up the second series values.

With the second cue key engaged the finger key values are:

The index finger tone key is L
The index finger semi-tone key is lower case open bracket (upper case close bracket )
The middle finger one key is M
The middle finger semi-tone key is lower case semi-colon ; upper case colon :
The third finger tone key is N
The third finger semi-tone key is 0
The little finger tone key is P
The little finger semi-tone key is full stop

FOURTH SERIES

The thumb depresses the cue key 20. This cues the finger keys to bring up the fourth series values. With cue key 20 engaged the values for the finger keys are:

The index finger tone key is Q
The index finger semi-tone key is lower case question mark ? upper case exclamation point !
The middle finger tone key is R the middle finger semi-tone key is lower case apostrophe ' upper case quotation marks "
The third finger tone key is S
The third finger semi-tone key is lower case hyphen - upper case forward slash /
The little finger tone key is T
The little finger semi-tone key is U

FIFTH SERIES

The thumb depresses the cue key 21. This cues the finger keys to bring up the fifth series values. With the cue key 21 engaged the values for the finger keys are:

The index finger tone key is V
The index finger semi-tone key is lower case acute accent _
upper case grave accent
These keys do not space automatically
The middle finger tone key is W
The middle finger semi-tone key is lower case accent circonflex upper case cedilla
These keys do not space automatically
The third finger tone key is X
The third finger semi-tone key is Y
The little finger tone key is Z
The little finger semi-tone key is comma,

THUMB CONTROL KEYS

The thumb key 22 is space.
The thumb key 23 is new line (carriage return)
The thumb key 24 is the shift key (upper case)

Hitting the shift key once cues the next letter to be upper case

The thumb key 25 locks and unlocks upper case (lock on/lock off)

Depressing and holding (for three seconds) the power on button turns the power on or off The "power on" button when touched is control key to assign numerical values to the finger keys as follows:

hitting the control key 26 once, depressing the cue key 19 (1) and hitting the entry key 12 (N) will cue the finger key section (and the CRT display if applicable) for numeric characters and mathematical functions. The finger keys will be assigned the characters 1, 2, 3, 4 correspondingly as shown in FIG. 2. Depressing the cue key "5" makes the "5" panel light up and changes the group of characters assigned to the finger keys (and the CRT display) to as shown in FIG. 3*b* opposite to the panel "5" at the left.

Hitting the control key 26, cue key "9" and entry key 12 decimal -point) cancels the numeric mode and brings up the alphabet mode. It is to note that the same key 12 corresponds to consonant "N" in alpha mode and to decimal point in number mode.

For the numeric mode the values are as follows:

SERIES ONE

The thumb is not used
The index finger is 1
The middle finger is 2
The third finger is 3
The little finger is 4

SERIES TWO

The thumb engages cue key 18
The index finger is 5
The middle finger is 6
The ring finger is 7
The little finger is 8

SERIES THREE

The thumb engages cue key 19
The index finger is 9
The middle finger 0
The third finger 15 (.) (decimal point)
The little finger is equal sign

SERIES FOUR

The thumb engages cue key 20,
The index finger is +
The middle finger is −
The third finger is ×
The fourth finger is ÷

SERIES FIVE

The thumb engages cue key 21
The index finger is √
The middle finger is %
The third finger is memory function
The fourth finger is clear N.B. Thumb keys are mute keys. They either cue (or do not cue) another series.

The above described embodiment is designed as a right-handed device. It is conceivable to design mirror-image, left-handed device also.

The analogy of the piano keyboard as presented in the exemplary embodiment is not the only possibility afforded by the invention. As seen in FIG. 8, a keyboard is structured on a cylindrical surface defining a control stick operable with one hand. Two sides of the same cylinder are shown in FIG. 8. The lower cylinder shown in FIG. 8 discloses that side of the cylinder facing the operator in which the operator places his thumb. The upper view of the cylinder shows the finger keys which are on the opposite side of the cylinder. The "piano" keyboard and the cylindrical keyboard assign the same values for each thumb/finger position o that a trained operator can go from one to the other embodiment without difficulty.

The device can be expanded by adding more thumb-operated keys to assign other values to the entry keys, if desired. It is not advisable, however, to increase the number of finger-operated key units since this could impair the mnemonic advantage of the system.

It will be appreciated that there is some redundancy built into the system deliberately. Firstly, thumb-operated key 22 provides "space" which is exactly the same function as assigned to finger key 15 (FIG. 1). Secondly, "full stop" can be generated by holding down key 19 and hitting (engaging) the semi-tone key 17 regardless of whether the system is in upper or lower case. That is whether the shift key 24 has or has not been engaged before hand.

I claim:

1. A device for one-handed generation of alphanumeric characters in an alpha or numeric mode including letters, numerals, punctuation marks and mathematical function symbols, comprising a finger key section comprising a first array of four finger keys and a second array of four finger keys, respective keys of said first and second arrays arranged in adjacent pairs, said finger keys each operable individually to generate a single character at a time, said first array of finger keys in an alpha mode assigned to the generation of all of the consonants and said second array of finger keys in an alpha mode being assigned to the generation of all of the vowels, one of said arrays in a numeric mode being assigned to the generation of numerals and mathematical symbols, a thumb key section comprising at least one array of four thumb keys, said thumb keys of said array in an alpha mode assigning said first array of finger keys to the generation of consonants and in a numeric mode assigning to one of said arrays the generation of numerals 0–9 and mathematical symbols, with each of the thumb keys of said at least one array operable to assign a preselected group of characters to said finger keys with the groups of characters to which the respective finger keys are assigned being arranged sequentially in alphabetical or numerical order and thumb-operated control key means comprising a plurality of said thumb keys initiating either said alpha or numeric mode, and means responsive to the operation of said keys for generating signals representing a particular alphanumeric character.

2. A device as claimed in claim 1, wherein said thumb-operated keys are adapted each to assign a group of up to and including eight different characters to said finger keys, one character to one finger key.

3. A device as defined in claim 1, wherein consonants are assignable to one array of finger keys and vowels are assignable to the other array of finger keys, the adjacent vowel key corresponding to the nearest consonant in alphabetical order.

4. A device as defined in claim 1, wherein said thumb keys are operable to perform additional functions including lower case/upper case shift, space, new line and shifting to numerals and mathematical functions.

5. A device as claimed in claim 1, wherein said arrays of finger keys are structured analogically to a piano keyboard, one of the said arrays of finger keys corresponding to the white keys of the keyboard and the other corresponding to the black keys of the keyboard.

6. A device as claimed in claim 1, wherein said first and second arrays of finger keys and the thumb keys are arranged on a cylinder in the form of a control stick.

7. A device as claimed in claim 1, wherein said thumb section comprises two arrays of four thumb keys each.

* * * * *